US008651571B1

(12) United States Patent
Richardson

(10) Patent No.: US 8,651,571 B1
(45) Date of Patent: Feb. 18, 2014

(54) MOUNTABLE CHILD SAFETY SEAT

(76) Inventor: Sheniynah Richardson, Columbus, OH (US)

( * ) Notice: Subject to any disclaimer, the term of this patent is extended or adjusted under 35 U.S.C. 154(b) by 0 days.

(21) Appl. No.: 13/612,452

(22) Filed: Sep. 12, 2012

(51) Int. Cl.
*A47C 31/00* (2006.01)

(52) U.S. Cl.
USPC ..... 297/217.7

(58) Field of Classification Search
USPC ..... 297/14, 217.7, 254, 255, 256, 256.1, 297/256.11
See application file for complete search history.

(56) References Cited

U.S. PATENT DOCUMENTS

| | | | | | |
|---|---|---|---|---|---|
| 2,851,084 | A * | 9/1958 | Benjetsky | ..... | 297/254 |
| 3,062,583 | A * | 11/1962 | Hamilton | ..... | 297/118 |
| 5,183,315 | A | 2/1993 | Takahashi et al. | | |
| 5,310,242 | A | 5/1994 | Golder | | |
| 5,362,123 | A | 11/1994 | Simmons | | |
| 5,857,226 | A * | 1/1999 | Sommer | ..... | 4/496 |
| 6,283,544 | B1 | 9/2001 | Alcala et al. | | |
| 7,891,034 | B2 * | 2/2011 | Smith | ..... | 5/655 |

* cited by examiner

*Primary Examiner* — Milton Nelson, Jr.

(57) ABSTRACT

A mountable child safety seat that can be mounted on a door and more preferably, either a bathroom stall door or a bathroom door. The child safety seat includes a number of support columns with adjustable inserts that can be used to accommodate bathroom doors of a wide variety of heights to allow an adult caregiver to secure the child safety seat to the door. The child safety seat includes a seat belt to ensure that the infant or toddler will be secure while using the child safety seat.

5 Claims, 6 Drawing Sheets

MOUNTABLE CHILD SAFETY SEAT

BACKGROUND OF THE INVENTION

Various types of mountable child safety seats are known in the prior art. However, what is needed is a mountable child safety seat that can be mounted on a door frame, and more specifically, a bathroom stall door frame, thereby improving the likelihood that a caregiver adult will be able to safely mount the child safety seat for a short time while using a toilet.

FIELD OF THE INVENTION

The present invention relates to a mountable child safety seat, and more particularly, to a mountable child safety seat that provides features and characteristics above and beyond existing mountable child safety seats.

SUMMARY OF THE INVENTION

The general purpose of the present mountable child safety seat, described subsequently in greater detail, is to provide a mountable child safety seat which has many novel features that result in a mountable child safety seat which is not anticipated, rendered obvious, suggested, or even implied by prior art, either alone or in combination thereof.

To accomplish this, the present mountable child safety seat comprises a child safety seat that can be mounted on a door, and more particularly, either a bathroom stall door or a bathroom door. The child safety seat includes a number of support columns with adjustable inserts that can be used to accommodate bathroom doors of a wide variety of heights to allow an adult caregiver to secure the child safety seat to the door. The child safety seat includes a seat belt to ensure that the infant or toddler will be secure while using the child safety seat.

Thus has been broadly outlined the more important features of the present mountable child safety seat so that the detailed description thereof that follows may be better understood and in order that the present contribution to the art may be better appreciated.

DETAILED DESCRIPTION OF THE DRAWINGS

Figure 1:
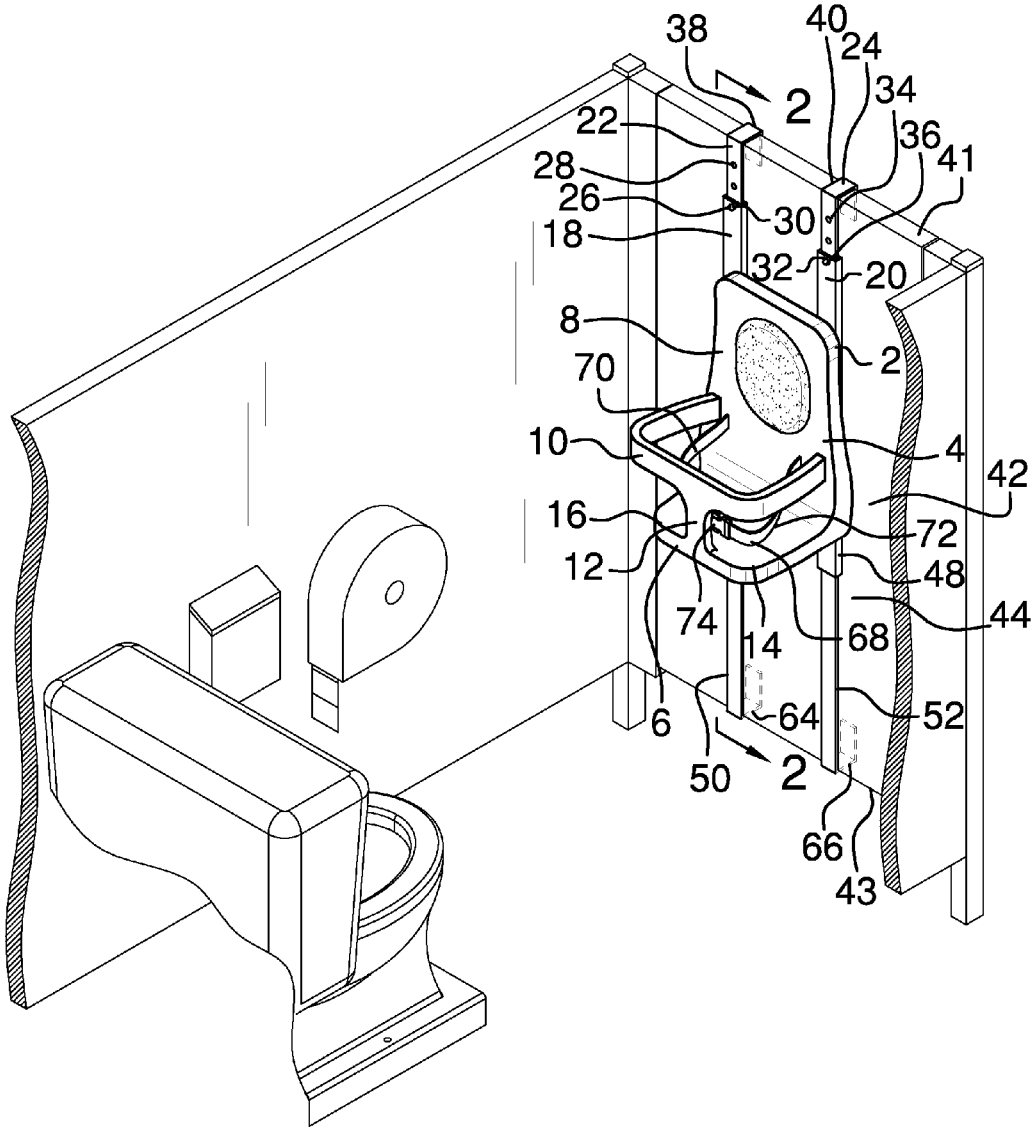
FIG. 1 is a perspective view of the mountable child safety seat as it would appear in use in a bathroom stall and mounted on a bathroom stall door.

With reference now to the drawings, and in particular FIGS. 1 through 6 thereof, an example of the instant mountable child safety seat employing the principles and concepts of the present mountable child safety seat and generally designated by the reference number 2 will be described.

Referring to FIGS. 1 through 6, a preferred embodiment of the present mountable child safety seat 2 is illustrated. The mountable child safety seat 2 comprises a seat 4 that has a base 6 and a backing 8 attached to the base 6. The seat 4 includes an external rigid retainer bar 10 that is connected to the backing 8, also being connected to the base 6 by a central support bar 12. Two leg holes 14 and 16 for a child are present as well.

Mountable child safety seat 2 has two upper support columns comprising a left upper support column 18 and a right upper support column 20. Left upper support column 18 has insert 22, which can be slidably inserted within left upper support column 18, while right upper support column 20 has insert 24, which can be slidably inserted within right upper support column 20.

Left upper support column 18 has a hole 26 on it, while insert 22 has a plurality of holes 28 linearly spaced out on insert 22 in an equidistant manner. Insert 22 can be temporarily fixed to a particular position in relation to left upper support column 18 by inserting a pin 30 through both hole 26 and one of the holes 28 on the insert 22.

Right upper support column 20 has a hole 32 on it, while insert 24 has a plurality of holes 34 linearly spaced out on insert 24 in an equidistant manner. Insert 24 can be temporarily fixed to a particular position in relation to right upper support column 20 by inserting a pin 36 through both hole 32 and one of the holes 34 on the insert 24.

Figure 2:
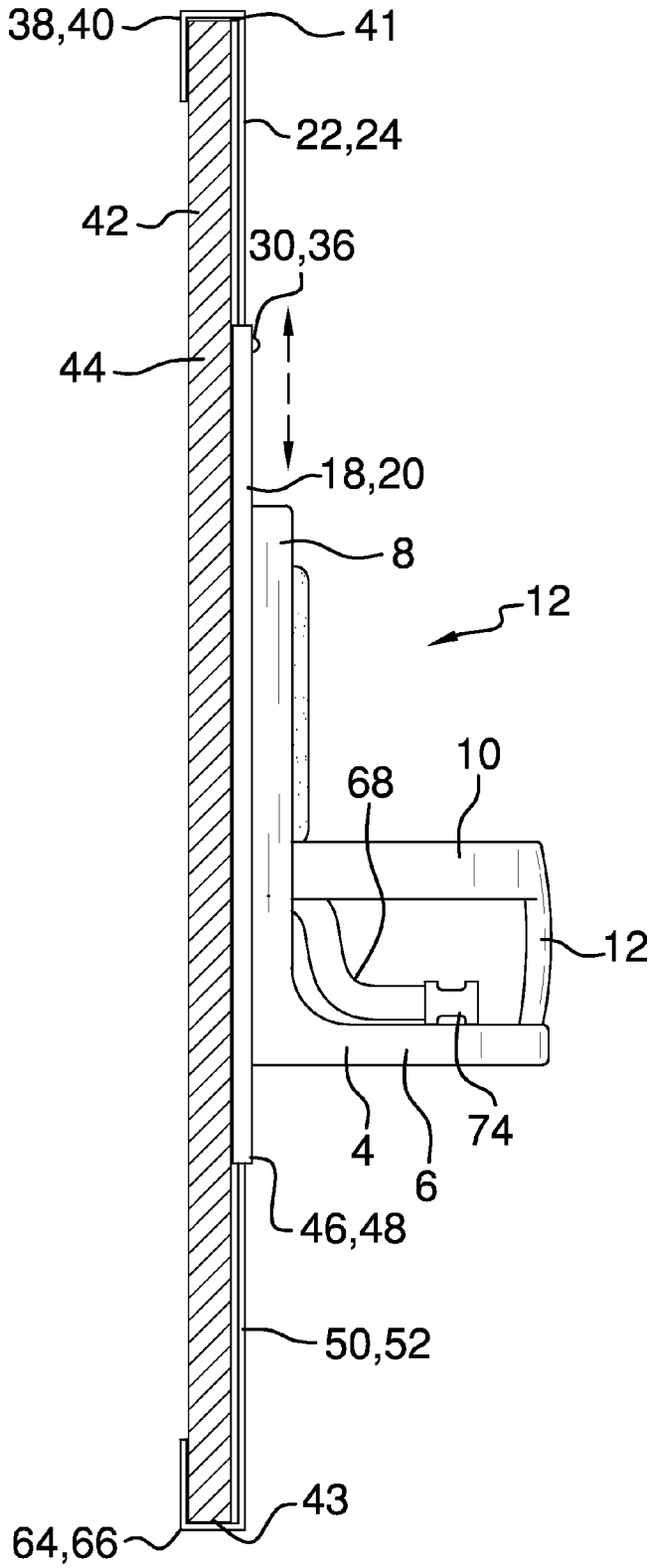
FIG. 2 is a side view of the mountable child safety seat as it would appear mounted on a bathroom stall door.
Figure 3:
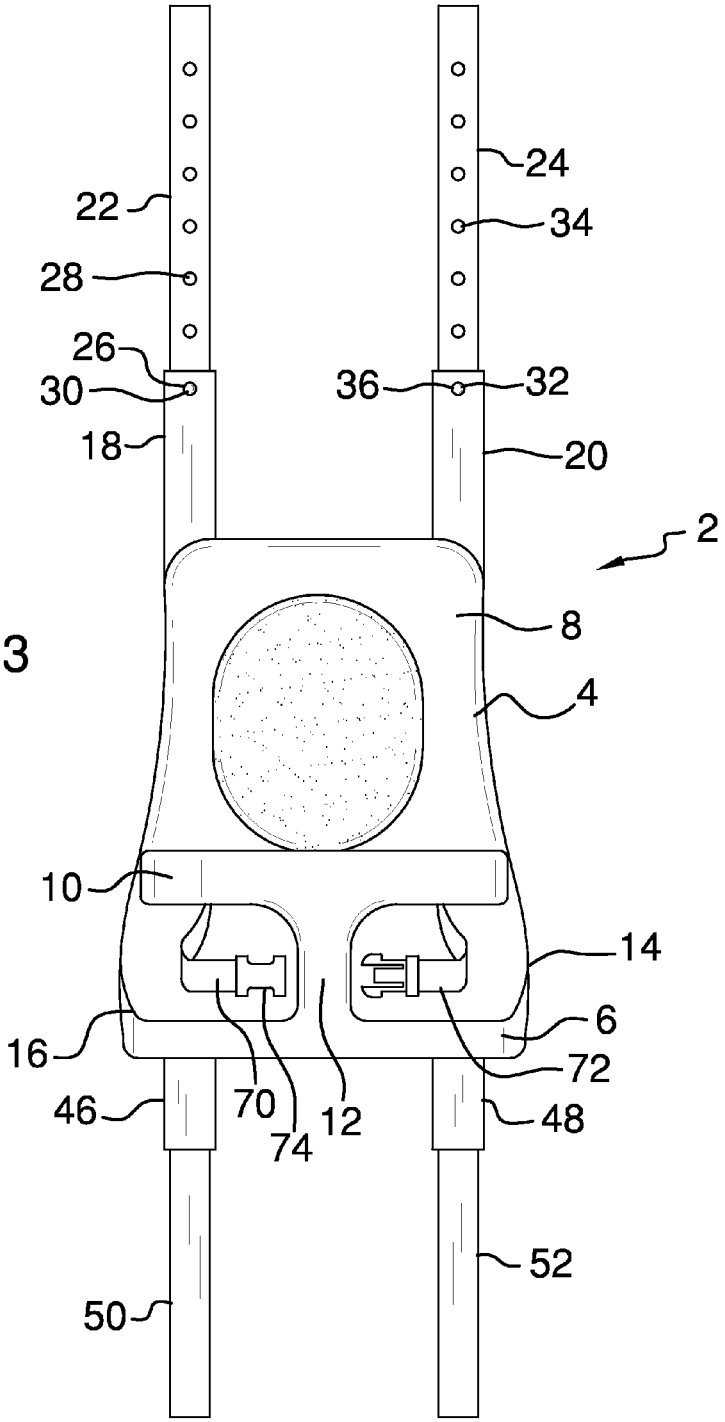
FIG. 3 is a front view of the mountable child safety seat as it would appear mounted on a bathroom stall door.
Figure 4:
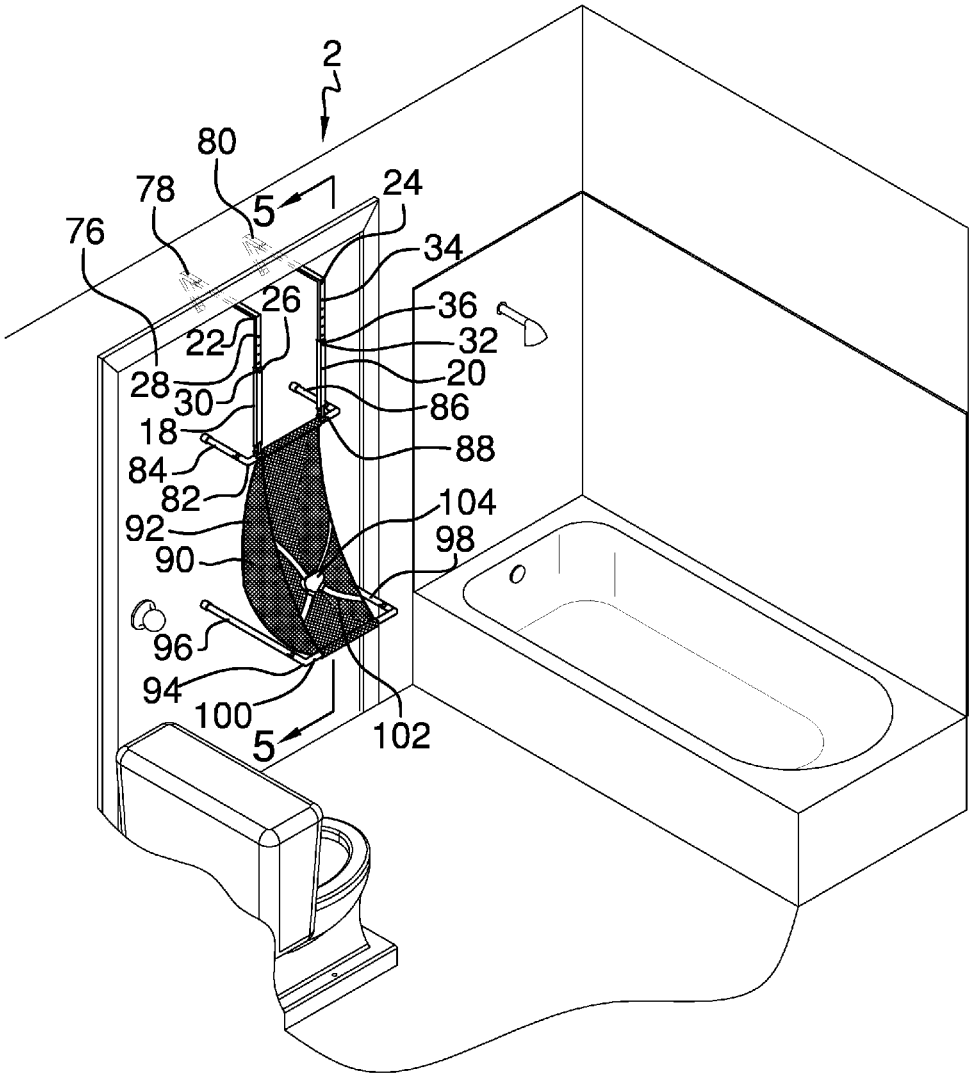
FIG. 4 is a perspective view of an alternative embodiment of mountable child safety seat as it would appear in use in a bathroom and mounted on a bathroom door.
Figure 5:
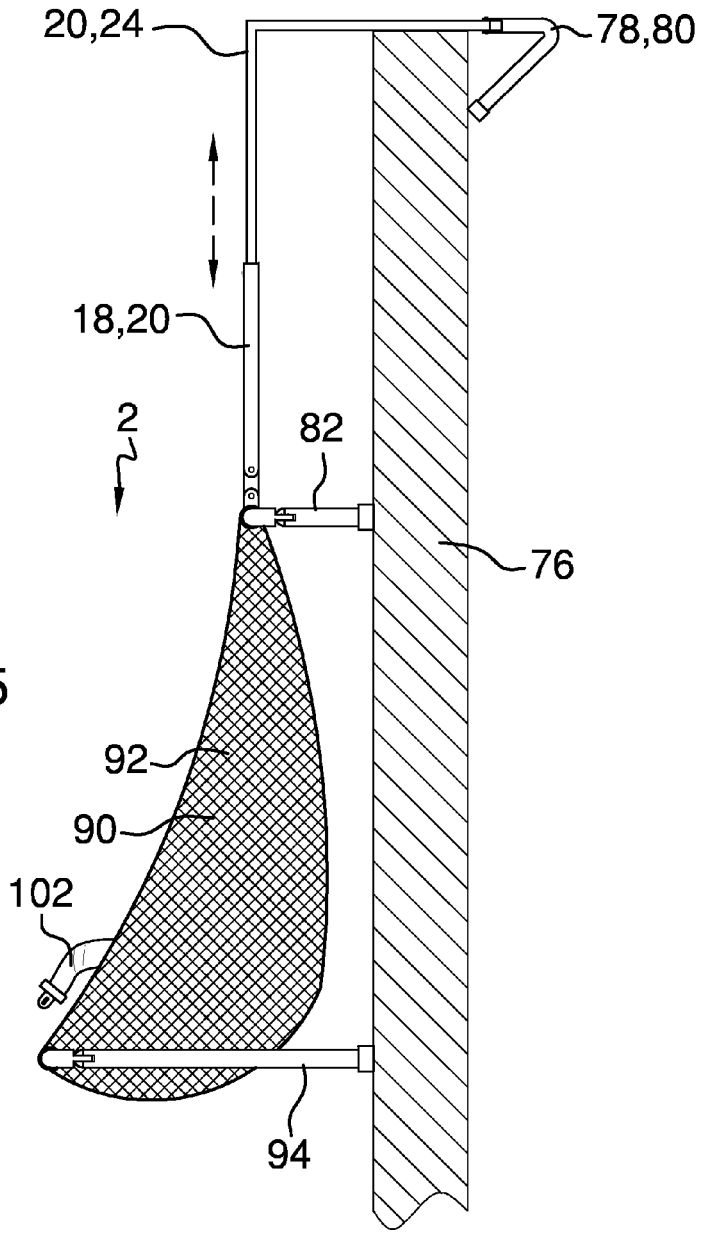
FIG. 5 is a side view of an alternative embodiment of mountable child safety seat as it would appear in use in a bathroom and mounted on a bathroom door.
Figure 6:
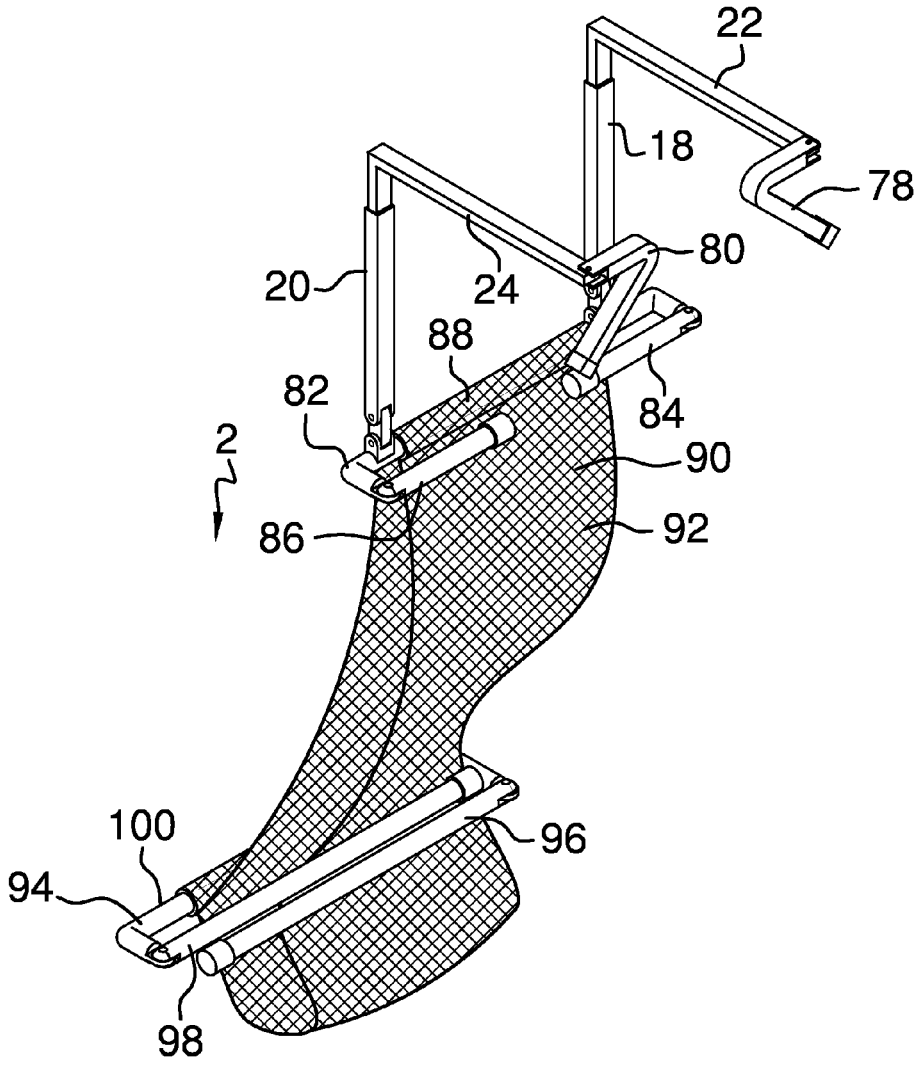
FIG. 6 is a rear isometric view of an alternative embodiment of mountable child safety seat as it would appear in use in a bathroom and mounted on a bathroom door.

Insert 22 has a hook 38 on it, while insert 24 has a hook 40 on it as well. Hooks 38 and 40 can be placed over the top edge 41 of a door 42, thereby mounting the mountable child safety seat 2 on the door 42 in question. FIGS. 1-3 highlight the use of mountable child safety seat 2 on a bathroom stall door 44.

Seat 2 also has two lower support columns comprising a left lower support column 46 and a right lower support column 48. Left lower support column 46 has insert 50, which can be slidably inserted within left lower support column 46, while right lower support column 48 has insert 52, which can be slidably inserted within right lower support column 48.

Insert 50 has a hook 64 on it, while insert 52 has a hook 66 on it as well. Hooks 64 and 66 can be placed around the bottom edge 43 of a door 42, thereby mounting the mountable child safety seat 2 on the door 42 in question. FIGS. 1-3 highlight the use of mountable child safety seat 2 on a bathroom stall door 44. By utilizing hooks to attach the mountable child safety seat 2 to the top edge 41 and bottom edge 43 of the door 42, the mountable child safety seat 2 becomes fairly secure against the door 42.

Mountable child safety seat 2 also has a seat belt 68 which is attached to the backing 8 of the seat 4. The seat belt 68 comprises a left strap 70 and a right strap 72 which are connectable via a buckle 74.

Mountable child safety seat 2 can alternatively be designed for use on a standard bathroom door 76 rather than a stall door 42. In this matter, inserts 22 and 24 would also include foldable back support rails 78 and 80, respectively. Foldable back support rail 78 is pivotally attached to insert 22, while foldable back support rail 80 is pivotally attached to insert 24.

As in the preferred embodiment, left upper support column 18 has a hole 26 on it, while insert 22 has a plurality of holes 28 linearly spaced out on insert 22 in an equidistant manner. Insert 22 can be temporarily fixed to a particular position in relation to left upper support column 18 by inserting a pin 30 through both hole 26 and one of the holes 28 on the insert 22.

Also as in the preferred embodiment, right upper support column 20 has a hole 32 on it, while insert 24 has a plurality of holes 34 linearly spaced out on insert 24 in an equidistant manner. Insert 24 can be temporarily fixed to a particular position in relation to right upper support column 20 by inserting a pin 36 through both hole 32 and one of the holes 34 on the insert 24.

Both left upper support column 18 and right upper support column 20 are attached to a top support foldable rail 82, which includes arms 84 and 86 that are pivotally attached to upper support rod 88. Seat 90, which comprises mesh netting 92, is attached to both the top support foldable rail 82 and a bottom support foldable rail 94, which is also placed against the bathroom door 76. Bottom support foldable rail 94 includes arms 96 and 98 that are pivotally attached to bottom support rod 100.

Seat 90 also incorporates a multi-part seat belt 102, which utilizes a buckle 104 in conjunction with the seat belt 102.

What is claimed is:

1. A mountable child safety seat comprising:

a seat, the seat further including a base;

a backing attached to the base;

a retainer bar connected to the backing;

a central support bar attached to the base, the central support bar also being attached to the retainer bar;

a pair of upper support columns comprising a left upper support column and a right upper support column;

wherein the left upper support column has a hole; further wherein the right upper support column has a hole;

a first pair of inserts comprising a first insert and a second insert, wherein the first insert of the first pair of inserts is slidably inserted within the left upper support column, wherein the second insert of the first pair of inserts is slidably inserted within the right upper support column;

a first plurality of holes linearly spaced out in an equidistant manner on the first insert of the first pair of inserts;

a second plurality of holes linearly spaced out in an equidistant manner on the second insert of the first pair of inserts;

a first pin, wherein the first pin can be used to affix the first insert of the first pair of inserts in relation to the left upper support column by inserting the first pin through the hole on the left upper support column and a hole of the first plurality of holes on the first insert of the first pair of inserts;

a second pin, wherein the second in can be used to affix the second insert of the first pair of inserts in relation to the right upper support column by inserting the second pin through the hole on the right upper support column and a hole of the second plurality of holes on the second insert of the first pair of inserts;

a first pair of hooks comprising a first hook and a second hook, wherein the first hook of the first pair of hooks is attached to the first insert of the first pair of inserts, wherein the second hook of the first pair of hooks is attached to the second insert of the first pair of inserts;

wherein each of the hooks of the first pair of hooks are placed over the top edge of a door, thereby mounting the mountable child safety seat on the door;

wherein the mountable child safety seat further comprises:

a pair of lower support columns comprising a left lower support column and a right lower support column;

a second pair of inserts comprising a first insert and a second insert, wherein the first insert of the second pair of inserts is slidably inserted within the left lower support column, wherein the second insert of the second pair of inserts is slidably inserted within the right lower support column;

a second pair of hooks comprising a first hook and a second hook, wherein the first hook of the second pair of hooks is attached to the first insert of the second pair of inserts, wherein the second hook of the second pair of hooks is attached to the second insert of the second pair of inserts;

wherein each of the hooks of the second pair of hooks are placed under the bottom edge of the door, thereby mounting the mountable child safety seat on the door.

2. A mountable child safety seat according to claim 1 wherein the mountable child safety seat further comprises:

a seat belt, wherein the seat belt further comprises a left strap attached to the backing of the seat;

a right strap attached to the backing of the seat; and a buckle, wherein the left strap and the right strap are connected to the buckle.

3. A mountable child safety seat according to claim 2 wherein the door to which the mountable child safety seat is attached further comprises a bathroom stall door.

4. A mountable child safety seat comprising:

a pair of upper support columns comprising a left upper support column and a right upper support column; wherein the left upper support column has a hole; further wherein the right upper support column has a hole;

a first pair of inserts comprising a first insert and a second insert, wherein the first insert of the first pair of inserts is slidably inserted within the left upper support column, wherein the second insert of the first pair of inserts is slidably inserted within the right upper support column;

a first plurality of holes linearly spaced out in an equidistant manner on the first insert of the first pair of inserts;

a second plurality of holes linearly spaced out in an equidistant manner on the second insert of the first pair of inserts;

a first pin, wherein the first pin can be used to affix the first insert of the first pair of inserts in relation to the left upper support column by inserting the first pin through the hole on the left upper support column and a hole of the first plurality of holes on the first insert of the first pair of inserts;

a second pin, wherein the second pin can be used to affix the second insert of the first pair of inserts in relation to the right upper support column by inserting the second pin through the hole on the right upper support column and a hole of the second plurality of holes on the second insert of the first pair of inserts;

a pair of foldable back support rails comprising a first foldable back support rail and a second foldable back support rail; wherein the first foldable back support rail is pivotally attached to the first insert of the first pair of inserts; wherein the second foldable back support rail is pivotally attached to the second insert of the first pair of inserts;

a top support foldable rail, wherein the top support foldable rail further comprises a first upper support rod;

a first pair of arms comprising a first arm and a second arm;

wherein each of the arms of the first pair of arms is attached to the first upper support rod;

wherein the top support foldable rail is attached to the left upper support column;

further wherein the top support foldable rail is attached to the right upper support column a seat;

wherein the seat is fabricated from mesh netting; wherein the seat is attached to the top support foldable rail;

a bottom support foldable rail, wherein the bottom support foldable rail further comprises a second upper support rod;

a second pair of arms comprising a first arm and a second arm;

wherein each of the arms of the second pair of arms is attached to the second upper support rod;

wherein the bottom support foldable rail is attached to the seat.

5. A mountable child safety seat according to claim 4 wherein the mountable child safety seat further comprises:

a multi-point seat belt; and a buckle associated with the multi-point seat belt.

* * * * *